US008979569B2

(12) United States Patent
Aekins

(10) Patent No.: US 8,979,569 B2
(45) Date of Patent: Mar. 17, 2015

(54) MODULAR CONNECTORS AND ASSOCIATED SYSTEMS AND METHODS

(71) Applicant: Robert A. Aekins, Quaker Hill, CT (US)

(72) Inventor: Robert A. Aekins, Quaker Hill, CT (US)

(73) Assignee: Ortronics, Inc., New London, CT (US)

( * ) Notice: Subject to any disclaimer, the term of this patent is extended or adjusted under 35 U.S.C. 154(b) by 77 days.

(21) Appl. No.: 13/835,280

(22) Filed: Mar. 15, 2013

(65) Prior Publication Data

US 2014/0273593 A1 Sep. 18, 2014

(51) Int. Cl.

| | |
|---|---|
| ***H01R 13/62*** | (2006.01) |
| ***H01R 13/633*** | (2006.01) |
| ***H01R 24/64*** | (2011.01) |
| *H01R 13/627* | (2006.01) |

(52) U.S. Cl.

CPC ..... *H01R 13/633* (2013.01); *H01R 24/64* (2013.01); *H01R 13/6272* (2013.01)

USPC ..... 439/352

(58) Field of Classification Search

USPC ..... 439/352

See application file for complete search history.

(56) References Cited

U.S. PATENT DOCUMENTS

| | | | | |
|---|---|---|---|---|
| 6,918,782 | B2 * | 7/2005 | Foster | 439/352 |
| 7,101,212 | B1 | 9/2006 | Larkin | |
| 7,163,414 | B2 * | 1/2007 | Lo et al. | 439/352 |
| 7,297,013 | B2 * | 11/2007 | Caveney et al. | 439/352 |
| 7,329,137 | B2 | 2/2008 | Martin et al. | |
| 7,465,180 | B2 * | 12/2008 | Kusuda et al. | 439/352 |
| 7,651,361 | B2 | 1/2010 | Henry et al. | |
| 7,686,638 | B2 * | 3/2010 | Boyd et al. | 439/344 |
| 8,317,532 | B2 | 11/2012 | Kosugi | |
| 8,556,645 | B2 * | 10/2013 | Crain | 439/352 |
| 8,632,352 | B2 * | 1/2014 | Wagner | 439/352 |
| 2003/0220008 | A1 * | 11/2003 | Viklund et al. | 439/352 |
| 2005/0124201 | A1 * | 6/2005 | Lo et al. | 439/352 |
| 2006/0134963 | A1 | 6/2006 | Lo et al. | |

FOREIGN PATENT DOCUMENTS

EP 1122566 A2 8/2001

OTHER PUBLICATIONS

PCT International Search Report and PCT Written Opinion from PCT/US14/24250 dated Jul. 7, 2014.
PCT/US14/24250, Mar. 12, 2014.

* cited by examiner

*Primary Examiner* — Gary Paumen
(74) *Attorney, Agent, or Firm* — McCarter & English, LLP

(57) ABSTRACT

Exemplary embodiments are directed to modular connector assemblies that generally include a connector and an attachment unit. The connector includes a connector housing, the connector housing including a first coupler element. The attachment unit includes an attachment unit housing, the attachment unit housing including a second coupler element. The first coupler element can be configured and dimensioned to interlock with the second coupler element for movably securing the connector to the attachment unit. Exemplary embodiments are also directed to methods and systems for modular connector assemblies.

18 Claims, 17 Drawing Sheets

MODULAR CONNECTORS AND ASSOCIATED SYSTEMS AND METHODS

TECHNICAL FIELD

The present disclosure relates to modular connectors and associated systems and methods and, in particular, to modular connectors for positioning a release action point such that interference with neighboring connectors in a high-density connector housing is minimized.

BACKGROUND

In the field of communications, a variety of data communication connectors and ports (also known as "jacks") are implemented to interconnect, e.g., telecommunications equipment, data equipment, and the like. FIG. 1 shows a conventional connector 100, e.g., a registered jack (RJ) connector, before insertion into a port 150, e.g., an RJ modular housing. The connector 100 includes a housing 102 and a set of contacts 104 disposed within the housing 102. The port 150 includes an opening 152 configured and dimensioned to receive the connector 100 and a set of contact pins 154 disposed within the port 150.

When the connector 100 is inserted into the port 150, the contacts 104 in the connector 100 come into electrical communication with the contact pins 154 of the port to create an electrical connection between the connector 100 and the port 150. In addition, when the connector 100 is inserted into the port 150, a latch 108 located on a spring-loaded release lever 106 of the connector 100 detachably interlocks with a latch groove 156 within the port 150 to releasably secure the connector 100 in the port 150 and to maintain an electrical connection between the connector 100 and the port 150.

FIG. 2 shows a side view of the conventional connector 100 inserted into the port 150. In particular, FIG. 2 shows the latch 108 on the release lever 106 of the connector 100 detachably interlocked with the latch groove 156 of the port 150. As shown in FIG. 3, to remove the connector 100 from the port 150, the end of the release lever 106 must be depressed by applying a force F. When the release lever 106 has been depressed, the connector 100 can be withdrawn/removed from the opening 152 of the port 150, as shown in FIG. 4.

The connector 100 shown in FIGS. 1-4 can be used, for example, to connect the end of an Unshielded Twisted Pair (UTP) cable to a standard port. UTP is a widely used type of data transfer media and is generally a flexible and/or low cost media. UTP can be used for voice and/or data communications and is becoming the de facto standard for Local Area Networks (LANs) and other in-building voice and/or data communications applications. The wide acceptance and use of UTP for data and voice transmission is generally due to the large installed base, low cost and/or ease of new installation. An additional feature of UTP is that it can be used for a variety of applications, e.g., Ethernet, Token Ring, FDDI, ATM, EIA-232, ISDN, analog telephone (POTS), other types of communication, and the like. This flexibility allows the same type of cable/system components (such as data jacks, plugs, cross-patch panels, and patch cables) to be used for an entire building, unlike shielded twisted pair (STP) media. There are typically four pairs of copper wires that are used for UTP, with each pair forming a twisted pair. The four pairs can be used in horizontal cabling, patch cabling and/or patch cordage. Patch cordage can be any unspecified length of UTP cable that is assembled by pressure crimping onto a RJ45 or similar type plug.

With reference to FIG. 5A, conventional connectors 100, e.g., top connector 100*a* and bottom connector 100*b*, are shown inserted into ports 150 of a multiple connector port housing 160, e.g., a multiple horizontal port device modular housing, a high-density patch panel, and the like. Although only two ports 150 are illustrated, it is known in the industry that multiple connector port housings 160 can include, e.g., forty-eight ports 150 in one rack unit of space, including multiple rows and columns of ports 150 positioned adjacent to each other. The large number of ports 150 can be accommodated by arranging the ports 150 in two rows and vertically aligning a port 150 in the first row and a port in the second row. Switching devices with similar high-density port 150 configurations are also known in the industry.

Still with reference to FIG. 5A, the top and bottom connectors 100*a* and 100*b* are shown in a vertically aligned position relative to each other. The top port 150 includes a top connector 100*a* and the bottom port 150 includes a bottom connector 100*b* inserted therein through the opening 152. As can be seen from FIG. 5A, when two or more top and bottom connectors 100*a* and 100*b* are positioned adjacent to each other in a multiple connector port housing 160, there is limited space for a user's finger(s) to access the release lever 106 of the bottom connector 100*b* due to the top connector 100*a* positioned directly above the release lever 106 of the bottom connector 100*b*. In particular, a release action point or removal area designated by area A is generally required to access and depress the release lever 106 with a force F to remove the bottom connector 100*b* from the port 150. As such, it can be cumbersome to remove the bottom connector 100*b* due to the space limitation. In addition, removing the bottom connector 100*b* can result in movement or dislodging of the top connector 100*a*, which could affect the electrical communication between the contacts 104 in the top connector 100*a* and the contact pins 154 of the top port 150.

FIG. 5B shows another view of conventional connectors, e.g., a top connector 100*a* and a bottom connector 100*b*, inserted into ports of a multiple connector port housing 160'. The components of FIG. 5B are substantially similar to the components shown in FIG. 5A. In particular, FIG. 5B further illustrates the limited space for a user's finger(s) 162 to access the release lever 106 of the bottom connector 100*b* due to the top connector 100*a* positioned directly above the release lever 106 of the bottom connector 100*b*. The area between the release lever 106 of the bottom connector 100*b* and a bottom surface of the top connector 100*a* is indicated in FIG. 5B as distance B'. In general, when a top and bottom connector 100*a* and 100*b* are inserted into vertically-aligned ports 150 in a conventional housing 160', the distance B' can be approximately 0.15 inches. The area A' indicated in FIG. 5B represents the release action point or removal area located between the top and bottom connectors 100*a* and 100*b* for a user's finger(s) 162 to pass to access and depress the release lever 106 of the bottom connector 100*b*. In conventional housings 160', the area A' can be approximately 0.4 inches. Due to the limited area A' and distance B', it is generally easier for a user to remove the top connector 100*a* in order to remove the bottom connector 100*b*. Thus, in addition to complicating the process for disconnecting a bottom connector 100*b*, the restricted area A' and distance B' of housings 160' with conventional connectors may require dual network disconnection, i.e., disconnection of both the top connector 100*a* and the bottom connector 100*b*.

Thus, a need exists for modular connectors which can be easily removed from a port located in a high-density connector port housing configuration, while preventing or reducing interference with electrical connections associated with surrounding connectors. These and other needs are addressed by the modular connectors and associated methods of the present disclosure.

SUMMARY

In accordance with embodiments of the present disclosure, exemplary modular connector assemblies are provided that generally include a connector that includes a connector housing and an attachment unit that includes an attachment unit housing. The connector housing generally includes a first coupler element. The attachment unit housing generally includes a second coupler element. The first coupler element can be configured and dimensioned to interlock with the second coupler element for detachably securing the connector to the attachment unit. In some embodiments, the first coupler element can be configured and dimensioned to interlock with the second coupler element for movably securing the connector to the attachment unit.

The first coupler element can be a female coupler element and the second coupler element can be a male coupler element. In some embodiments, the first coupler element can be a male coupler element and the second coupler element can be a female coupler element. The female coupler element can include two channels. The male coupler element can include two protrusions. In some embodiments, the first coupler element can be more than two male coupler elements and the second coupler element can be more than two female coupler elements. The two channels can be configured and dimensioned to receive therein the two protrusions. Each of the two protrusions can include a catch member. Each of the two channels can include a stop member for releasably interlocking with the catch member of each of the two protrusions.

The connector housing generally includes a connector opening and defines a connector interior space. The attachment unit housing generally includes an attachment unit opening complementary to the connector opening and defines an attachment unit interior space. The connector generally includes a release lever and a latch slide. The attachment unit generally includes an actuation lever which includes a living hinge. The latch slide includes an opening passing therethrough configured and dimensioned to receive the actuation lever of the attachment unit therethrough. The latch slide also includes an angled surface configured and dimensioned to receive thereon a surface of the actuation lever. The release lever generally defines a release lever distal end, e.g., a free end, and the actuation lever defines an actuation lever distal end, e.g., a free end. The release lever distal end and the actuation lever distal end can be configured and dimensioned to releasably mate relative to each other such that actuation of the actuation lever actuates the release lever. For example, the free end of the release lever can define a flat surface and the free end of the actuation lever can define a curved surface. In some embodiments, the free end of the release lever can define a hook and the free end of the actuation lever can define a pin. Thus, when the attachment unit is movably secured to the connector unit, movement of the free end of the actuation lever results in movement of the free end of the release lever. Further, when the attachment unit is movably secured to the connector unit, movement of the free end of the actuation lever generally results in movement of the free end of the release lever.

In accordance with embodiments of the present disclosure, exemplary methods of modular connector assembly are provided that generally include providing a connector that includes a connector housing and providing an attachment unit that includes an attachment unit housing. The connector housing generally includes a first coupler element. The attachment unit housing generally includes a second coupler element. The exemplary method includes detachably securing the connector relative to the attachment unit by interlocking the first coupler element relative to the second coupler element such that the connector and the attachment unit are in mechanical communication relative to each other. In some embodiments, the method includes movably securing the connector relative to the attachment unit by interlocking the first coupler element relative to the second coupler element.

The first coupler element can be a female coupler element and the second coupler element can be a male coupler element. In some embodiments, the first coupler element can be a male coupler element and the second coupler element can be a female coupler element. The female coupler element includes two channels and the male coupler element includes two protrusions. Each of the two protrusions generally includes a catch member and each of the two channels includes a stop member for releasably interlocking with the catch member of each of the two protrusions. Interlocking the first coupler element relative to the second coupler element generally includes interlocking the catch members of the two protrusions with the stop members of the two channels.

The connector generally includes a release lever and a latch slide. The attachment unit generally includes an actuation lever, the actuation lever including a living hinge. The exemplary method includes passing the actuation lever through an opening formed in the latch slide. The release lever generally defines a release lever distal end and the actuation lever defines an actuation lever distal end. The method includes releasably mating the release lever distal end and the actuation lever distal end relative to each other. The method further includes pulling the attachment unit in a direction away from the connector to depress the release lever.

In accordance with embodiments of the present disclosure, exemplary modular connector systems are provided that generally include a modular connector assembly and a port housing. The modular connector assembly generally includes a connector that includes a connector housing, the connector housing including a first coupler element. The modular connector assembly generally also includes an attachment unit that includes an attachment unit housing, the attachment unit housing includes a second coupler element. The first coupler element can be configured and dimensioned to interlock with the second coupler element for detachably securing the connector to the attachment unit. In some embodiments, the attachment unit can be movably secured to the connector through an interlocking between the first coupler element and the second coupler element. The port housing can be configured and dimensioned to detachably receive therein at least a portion of the connector. In some embodiments, the port housing can be configured and dimensioned to releasably secure therein the connector for establishing an electrical communication between a contact inside the connector and a conductive member inside the port housing. Actuating, e.g., pulling, translating, and the like, the attachment unit in a direction away from the connector generally detaches and/or releases the connector from the port housing. The connector generally includes a release lever and the attachment unit generally includes an actuation lever. Actuation of the actuation lever results in actuation of the release lever.

In accordance with embodiments of the present disclosure, exemplary modular connector assemblies are provided that generally include a connector and an attachment unit. The connector generally includes a release lever. The attachment unit generally includes an actuation lever. The connector and the attachment unit can be configured and dimensioned to be detachably interlocked relative to each other such that the connector and the attachment unit are in mechanical communication relative to each other. Actuation of the actuation lever generally actuates the release lever. In some embodiments, the assembled connector and attachment unit can remain movable relative to each other. Thus, the attachment unit can be moved in a direction away from the connector to actuate the actuation lever of the attachment unit and to actuate the release lever of the connector.

In accordance with embodiments of the present disclosure, exemplary methods of modular connector assembly are provided that generally include providing a connector and providing an attachment unit. The connector generally includes a release lever. The attachment unit generally includes an actuation lever. The method generally includes detachably interlocking the connector relative to the attachment unit. The method further includes actuating the actuation lever of the attachment unit to actuate the release lever of the connector. In some embodiments, the method includes assembling the connector and the attachment unit such that the attachment unit remains movable relative to the connector. The method generally includes moving the attachment unit in a direction away from the connector to actuate the actuation lever of the attachment unit and to actuate the release lever of the connector.

Prior to the step of moving the attachment unit in a direction away from the connector, the method includes, inserting the connector into a port housing to establish electrical communication between a contact in the connector and a conductive member in the port housing. After the step of moving the attachment unit in a direction away from the connector, the method generally includes removing the connector from the port housing to break the electrical communication between the contact in the connector and the conductive member in the port housing. During the step of moving the attachment unit in a direction away from the connector, the attachment unit can translate relative to the connector. After the step of moving the attachment unit in a direction away from the connector, the method generally includes automatically moving the attachment unit in a direction towards the connector.

In accordance with embodiments of the present disclosure, exemplary modular connector systems are provided that generally include a modular connector assembly and a port housing. The modular connector assembly generally includes a connector and an attachment unit. The connector includes a release lever and the attachment unit includes an actuation lever. The connector and the attachment unit can be configured and dimensioned to be detachably interlocked relative to each other. The port housing can be configured and dimensioned to detachably receive therein the connector. Actuating the actuation lever of the attachment unit actuates the release lever of the connector to detach the connector from the port housing.

In accordance with embodiments of the present disclosure, exemplary modular connector assemblies are provided that generally include a connector and an attachment unit. The connector generally includes a connector housing that includes a first coupler element, at least one contact located within the connector housing, and a release lever. The attachment unit generally includes an attachment unit housing that includes a second coupler element. The first coupler element can be configured and dimensioned to interlock with the second coupler element to movably secure the connector to the attachment unit. The assemblies can generally include means for actuating the release lever when the attachment unit is movably secured to the connector. In general, the assemblies include means for allowing a user to grasp a back end of the attachment unit.

Other objects and features will become apparent from the following detailed description considered in conjunction with the accompanying drawings. It is to be understood, however, that the drawings are designed as an illustration only and not as a definition of the limits of the invention. Further, the various features and/or combinations of features described herein and illustrated in the accompanying figures can be arranged and/or organized differently to result in exemplary embodiments which are still within the spirit and scope of the present disclosure.

BRIEF DESCRIPTION OF THE DRAWINGS

To assist those of skill in the art in making and using the disclosed modular connectors and associated systems and methods, reference is made to the accompanying figures, wherein.

DESCRIPTION OF EXEMPLARY EMBODIMENT(S)

Figure 1:
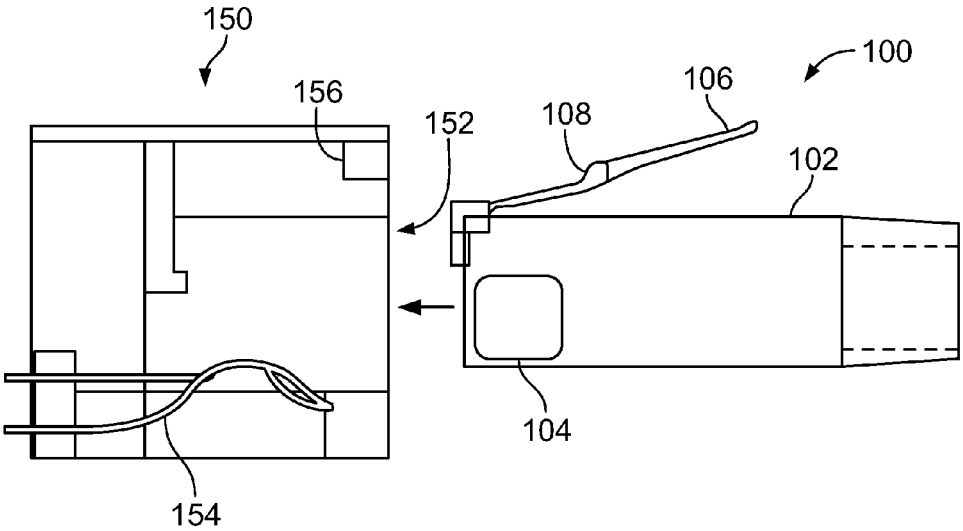
FIG. 1 (Prior Art)
FIG. 1 is a side view of a connector of the prior art prior to insertion into a port housing with contact pins.
Figure 2:
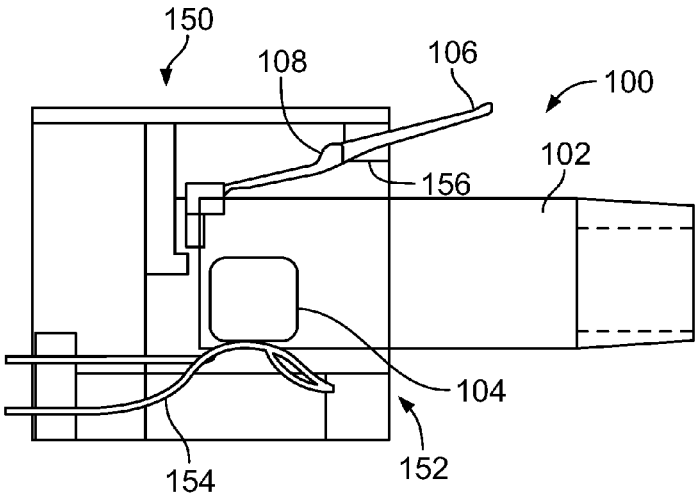
FIG. 2 (Prior Art)
FIG. 2 is a side view of a connector of the prior art inserted into a port housing with contact pins.
Figure 3:
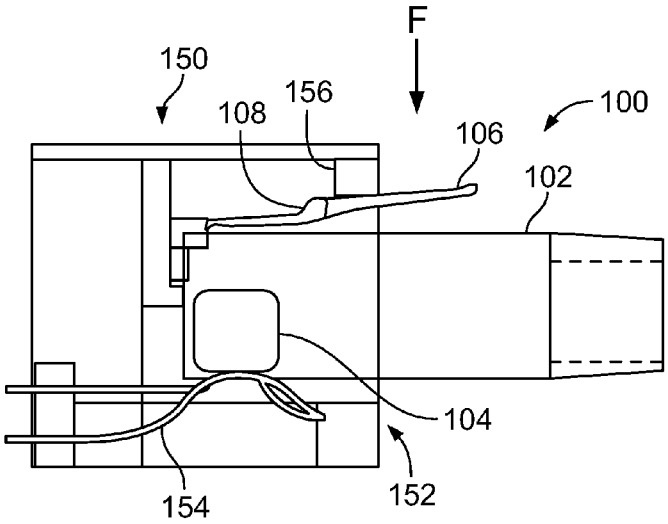
FIG. 3 (Prior Art)
FIG. 3 is a side view of a connector of the prior art inserted into a port housing with contact pins.
Figure 4:
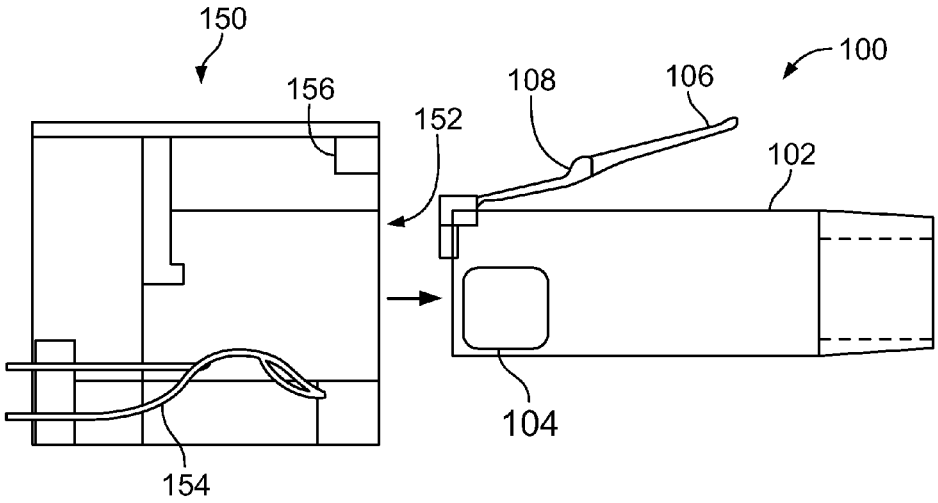
FIG. 4 (Prior Art)
FIG. 4 is side view of a connector of the prior art removed from a port housing with contact pins.

In the description which follows, like parts are marked throughout the specification and figures with the same reference numerals. Figures are not necessarily to scale and, in certain views, parts may have been exaggerated for purposes of clarity. It should be understood that the relative terminology used herein, such as "front", "rear", "left", "top", "bottom", "vertical", and "horizontal" is solely for the purposes of clarity and designation and is not intended to limit the invention to embodiments having a particular position and/or orientation. Accordingly, such relative terminology should not be construed to limit the scope of the present invention.

The present disclosure relates to modular connector assemblies for connecting the connectors of cables containing wires transmitting digital or analog signals to standard ports or jacks, such as those on computer-networking switches or on patch panels. It should be understood that the terms "port" and "jack" are used interchangeably in this disclosure. The exemplary connector assemblies interface with high frequency transmission media, e.g., RJ type connectors, such as those used for the ends of unshielded twisted pair patch cables. The present disclosure also relates to methods for removing a connector, e.g., an RJ latched plug assembly, from a port or jack, e.g., an RJ modular housing, which is either a single port or a multiport housing device. The exemplary assemblies and methods described herein allow for advantageous and convenient disconnection of the connector from a port without disruption to the electrical connections established by neighboring connectors and ports. For example, the exemplary connector assemblies move the location of the release action point to a more advantageous region such that sufficient room exists for removal of an exemplary connector from a high-density connector housing, e.g., a housing for a device with forty-eight ports that fits in one rack unit of space.

Figure 6:
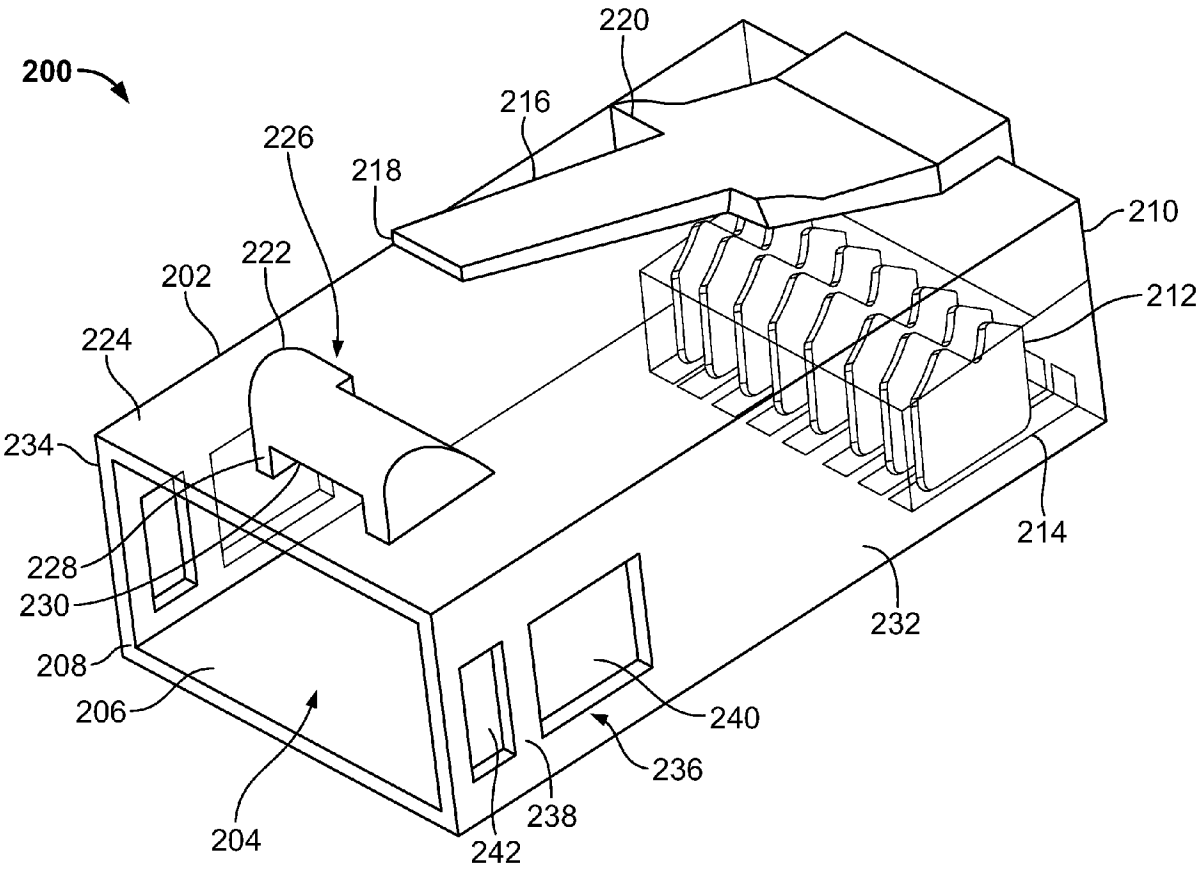
FIG. 6 is a perspective view of an exemplary connector of a modular connector assembly according to the present disclosure.

With reference to FIG. 6, a perspective view of an exemplary connector 200, e.g., a communication plug, of a modular connector or plug assembly is provided. The connector 200 generally includes a connector housing 202. The housing 202 can be fabricated from, e.g., a plastic, any other non-conductive material, and the like. The housing 202 includes an opening 204 at a rear end 208 and an interior space 206 defined by the cavity within the housing 202 which can be accessed through the opening 204. The interior space 206 at the front end 210 of the connector 200 includes a plurality of insulation displacement contacts (IDCs) 212.

For example, FIG. 6 shows the connector 200 with eight IDCs 212 to correspond to the eight wires in a Category 5 or Category 6 UTP cable. However, it should be understood that the exemplary connector 200 can be used for a variety of cables having different amounts of IDCs 212. When the connector 200 is connected to a cable (not shown), the wires of the cable can pass through the opening 204, into the interior space 206 and terminate at the IDCs 212 such that each wire is in electrical communication with a respective IDC 212. The exterior of the housing 202 includes a plurality of openings 214 corresponding to the number of IDCs 212 in the connector 200 to permit each IDC 212 to electrically connect with a corresponding terminal or contact pin on a jack or port when the modular connector 200 is inserted in the jack or port.

The connector 200 also includes a release lever 216, e.g., a flexible or spring-loaded release lever, fixated to and protruding from the top surface 224 of the housing 202. The release lever 216 can be used to detachably interlock or secure the connector in an opening of a port or jack. In particular, the release lever 216 defines a free or rear end 218 and includes shoulders 220, e.g., latches, protrusions, and the like, on each side of the release lever 216. When the connector 200 is inserted into a port, the shoulders 220 can bear against an interior of a front wall of the port, e.g., a latch groove, such that the connector 200 is releasably secured in the port and is protected from being accidentally dislodged. To remove the connector 200 from the port, a user must depress the release lever 216 such that the rear end 218 moves in the direction towards the top surface 224 of the housing 202. It should be understood that the normal position of the flexible or spring-loaded release lever 216 is protruding in an angled or upward direction from the top surface 224 of the housing 202. In particular, the spring-loaded force acts to push the rear end 218 of the release lever 216 in an upward direction away from the top surface 224 of the housing 202. When the release lever 216 is depressed, the shoulders 220 also move in the direction towards the top surface 224 of the housing 202 such that the shoulders 220 can clear the latch groove, i.e., the obstruction created by the port, thereby allowing removal of the connector from the port. When the release lever 216 is no longer depressed, it can spring back into its normal position.

Figure 12:
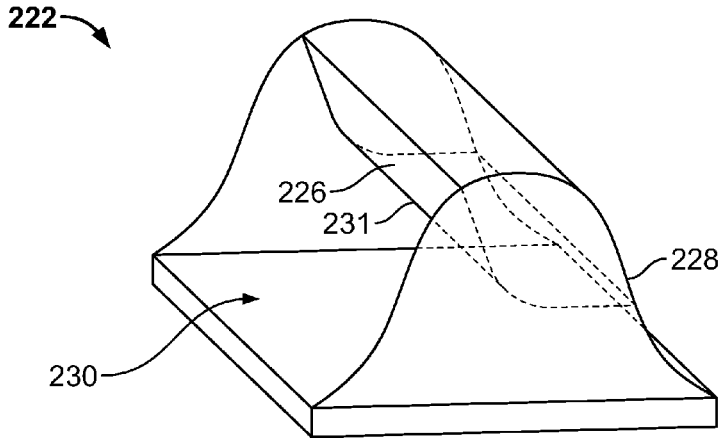
FIG. 12 is a perspective view of an exemplary latch slide according the present disclosure.

The connector of FIG. 6 also includes a latch slide 222 on the top surface 224 of the housing 202. The latch slide 222 can be integrally formed with the housing 202 through, e.g., molding. In some embodiments, the latch slide 222 can be attached to the housing 202 as a separate component. FIG. 12 shows an enlarged perspective view of the latch slide 222. The latch slide 222 defines a front side 226 and a rear side 228. An opening 230 at the bottom of the latch slide 222 can extend through the latch slide 222 from the front side 226 to the rear side 228. The front side 226 of the latch slide 222 can define an angled planar surface that extends from the top front edge 231 of the opening 230 to near the top of the front side 226 of the latch slide 222.

The right side 232 and left side 234 of the connector 200 can also include a first coupler element, e.g., a female coupler element configured as channels 236 or openings within the housing 202 walls. The channels 236 can be configured as, e.g., rectangular, square, and the like. The opening into each channel 236 can begin at or near the rear end 208 of the housing 208 and the channel 236 can extend a predetermined distance into the housing 202 wall, i.e., a distance sufficient to receive the second coupler element discussed below. The first coupler element can also include a stop member 238 dividing each channel 236 into a front channel portion 240 and a rear channel portion 242. The functions of the latch slide 222, the channels 236 and the stop member 238 are explained in greater detail below.

Figure 7:
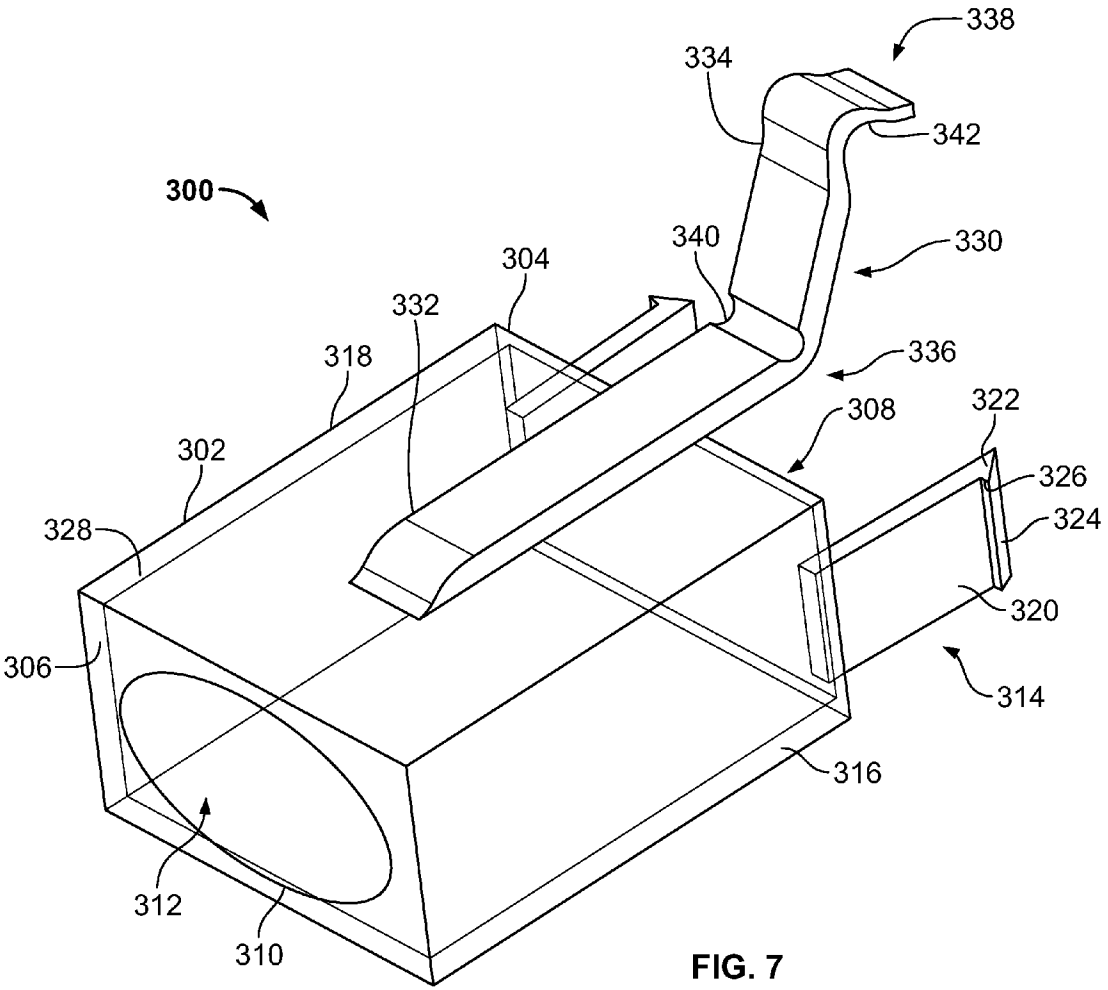
FIG. 7 is a perspective view of an exemplary attachment unit of a modular connector assembly according to the present disclosure.

FIG. 7 is a perspective view of an exemplary attachment unit 300, e.g., a rear unit, of a modular connector or plug assembly. The attachment unit 300 defines a housing 302 which includes a front end 304 and a rear end 306. The housing 302 can be fabricated from, e.g., a plastic, a non-conductive material, and the like. The front end 304 includes a first opening 308, e.g., a rectangular opening, and the rear end 306 includes a second opening 310. The second opening 310 can be configured as, e.g., circular, elliptical, rectangular, square, and the like. The first opening 308 can be configured and dimensioned substantially similarly to the opening 204 of the connector 200. Both the first and second opening 308 and 310 connect to an interior space 312 of the housing 302. When the connector 200 and the attachment unit 300 are detachably and/or movably secured relative to each other, the mating of the opening 204 of the connector 200 and the first opening 308 of the attachment unit 300 can form a substantially uniform interior space.

The attachment unit 300 generally includes a second coupler element, e.g., a male coupler element defining a protrusion 314. The protrusion 314 can be, e.g., a rectangular protrusion extending from the front end 304 of the right side 316 and the left side 318 of the housing 302. In some embodiments, the protrusion 314 configuration can be varied so long as the protrusion 314 remains complementary to the channels 236 of the connector 200. Each protrusion 314 includes a protrusion body 320 and a catch member 322. The catch member 322 generally defines an angled front surface 324 and a substantially flat rear surface 326. The protrusions 314 can extend from the front end 304 of the housing 302 in a cantilever manner. The protrusions 314 can be fabricated from, e.g., a plastic, a non-conductive material, and the like, and can be integrally formed within the housing 302 of the attachment unit 300 by, e.g., molding. In particular, the protrusions 314 can be dimensioned to have a spring-like or flexible property. Thus, when the protrusions 314 are inserted into the channels 236 of the connector 200 during assembly of the modular connector assembly, the flexibility of the protrusions 314 and the angled front surface 324 of the catch member 322 allows each catch member 322 to move past and beyond the respective stop member 238 and deeper into the channel 236. The flexibility of the protrusions 322 during insertion of the catch members 322 beyond the stop member 238 can create a "snap fit" when the catch member 322 is advanced beyond the stop member 238. The catch member 322 of the protrusions 314 can thereby pass from the rear portion 242 to the front portion 240 of the channel 236. Once the protrusions 314 have been inserted into the channels 236 of the connector 200, the catch members 322 are prevented from moving back and out of the channels 236 by the stop members 238. In particular, the flat rear surface 326 of the catch members 322 abuts the stop members 238 and prevents the protrusions 314 from being withdrawn from the channels 236. It should be understood that a compressive force can be applied onto the protrusions 314 and/or catch members 322 to slightly bend the protrusions 314 inwardly such that the catch members 322 can move past the stop members 238 to remove the protrusions 314 from the channels 236.

The top surface 328 of the housing 302 includes an actuation lever 330, e.g., a protrusion extending in the direction of the front end 304 of the housing 302. The actuation lever 330 includes a fixed portion 332 and a lever portion 334. The fixed portion 332 can be fixed to the top surface 328 of the housing 302 and can extend from near the center of the top surface 328 of the housing 302 past the front end 304 of the top surface 328 of the housing 302. A front end 336 of the lever portion 334 can be connected to the protruding fixed portion 332 via a hinge 340, e.g., a living hinge. The hinge 340 can have a spring-like property to maintain the lever portion 334 in a normal position, e.g., substantially perpendicular to the fixed portion 332, unless a force is applied to the lever portion 334. The free or rear end 338 of the lever portion 334 can be curved in a downwards direction to form a hooked shape. It should be understood that the term "rear end", when used with respect to the lever portion 334 of the actuation lever 330, identifies the end of the lever portion 334 which is not connected to the hinge 340, i.e., the free end, and not the end of the lever portion 334 which his more rearward in relation to the orientation of the attachment member 300. For example, the rear end 338 of the lever portion 334 can be bent at an angle relative to the front end 336 of the lever portion 334 and can define a mating surface 342 for mating with the rear end 218 of the release lever 216 of the connector 200.

Figure 8:
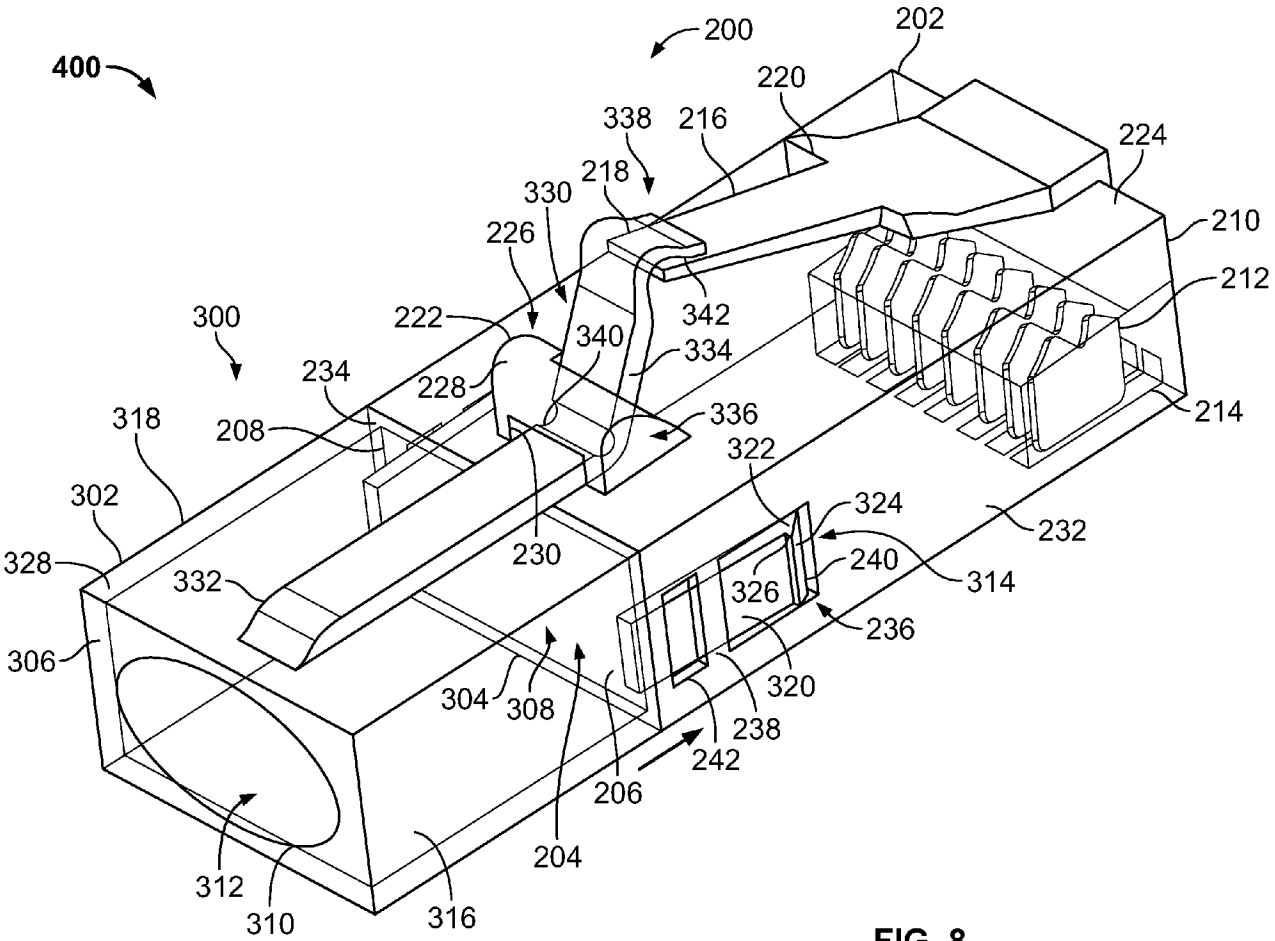
FIG. 8 is a perspective view of an exemplary modular connector assembly according to the present disclosure.

Turning now to FIG. 8, a perspective view of an exemplary modular connector assembly 400 (hereinafter "assembly 400") is provided. In particular, the assembly 400 includes an exemplary connector 200 detachably and/or movably interlocked relative to the exemplary attachment unit 300. To attach the attachment unit 300 to the connector 200, the rear end 338 of the actuation lever 330 can be pressed in the direction of the top surface 328 of the housing 302 such that the lever portion 334 is substantially parallel with the top surface 328 of the housing 302. When the lever portion 334 has been oriented in this substantially parallel position, the lever portion 334 can be passed through the opening 230 on the bottom of the latch slide 222. The lever portion 334 can be passed through the opening 230 as the protrusions 314 are inserted into the channels 236 such that the catch members 322 advance past the stop members 238.

After the lever portion 334 has passed through the opening 230 of the latch slide 222, the bias of the living hinge 340 can force the lever portion 334 to rotate about the living hinge 340 (with the living hinge 340 serving as a fulcrum) such that the rear end 338 of the lever portion 334 moves upwards and away from the top surface 328 of the housing 302. The lever portion 334 can continue to rotate about the living hinge 340 until the lever portion 334 rests against the angled front side 226 of the latch slide 222. The angle of the front side 226 and/or the dimensions of the opening 230 can be selected to be compatible with the dimensions of the actuation lever 330. When the lever portion 334 is positioned against the angled front side 226 of the latch slide 222, the curved rear end 338 of the lever portion 334 can be positioned to surround and/or mate against the rear end 218 of the release lever 216 of the connector 200. In particular, the mating surface 342 of the rear end 338 of the lever portion 334 can be positioned adjacent to and pressed against the top surface of the rear end 218 of the release lever 216. However, it should be understood that the mated rear ends 338 and 218 maintain the release lever 216 in an expanded position, i.e., the release lever 216 is substantially raised to its highest position. Thus, actuation of the lever portion 334 can, in turn, actuate the release lever 216. Prior to and/or after the assembly 400 has been assembled, the assembly 400 can be connected to a cable, e.g., a Category 5, a Category 6, and the like, UTP cable such that the ends of the wires in the cable terminate at the IDCs 212 contained within the housing 202 of the connector 200. In particular, the wires in the cable can pass through the second opening of the attachment unit 300, through the interior space 312 of the attachment unit, through the first opening 308 of the attachment unit 300 and the opening 204 of the connector 200, and into the interior space 206 of the connector 200. For example, an assembler can first pass the end of the cable through the attachment unit 300. Next, the assembler can attach the end of the cable to the connector 200 such that the wires in the cable terminate at the contacts 212. Further, the assembler can secure attachment unit 300 to the connector 200 in a manner described above such that the attachment unit 300 can move relative to the connector 200 to actuate the release lever 216.

Figure 9:
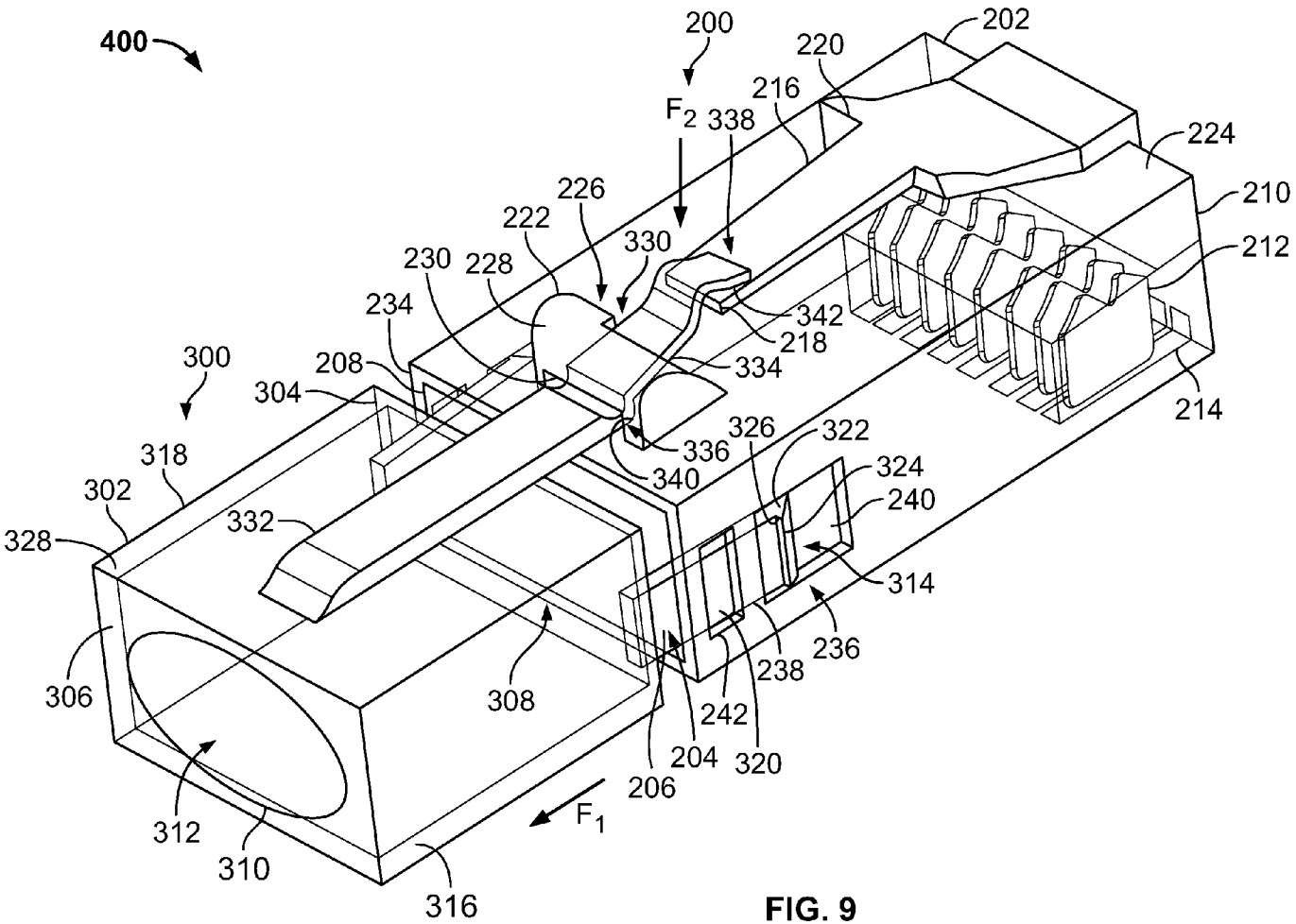
FIG. 9 is a perspective view of an exemplary modular connector assembly with a attachment unit pulled away from a connector according to the present disclosure.

With reference to FIG. 9, the effect of translating the attachment unit 300 of the assembly 400 away from the connector 200 is shown. In particular, when the attachment unit 300 is translated away from the connector 200 by a force $F_1$ in the direction indicated in FIG. 9, the living hinge 340 also translates away from the connector 200. The translation of the living hinge 340 prevents the lever portion 334 of the actuation lever 330 from resting on the angle front side 226 of the latch slide 222. Rather, translating the attachment unit 300 away from the connector 300 forces the lever portion 334 to rotate about the living hinge 340 such that the rear end 338 of the lever portion 334 moves in a downward direction toward the top surface 328 of the housing 302. Thus, application of force $F_1$ on the attachment unit 300 forces the mating surface 342 to apply a force $F_2$ on the top surface of the rear end 218 of the release lever 216. Since the mating surface 342 of the lever portion 334 is positioned against the top surface of the rear end 218 of the release lever 216, actuation of the lever portion 334 in a downward direction simultaneously actuates the rear end 218 of the release lever 216 to move in a downward direction toward the top surface 224 of the connector 200, thereby rotating the release lever 216 in a downward direction at its fulcrum point. When the assembly 400 is inserted into a port or jack, the downward motion of the rear end 218 of the release lever 216 described above allows the shoulders 220 on the release lever 216 to clear the walls of the port, thus permitting removal of the assembly 400 from the port. The second opening 310 in the rear end 306 of the housing 302 can be sized such that translation of the attachment unit 300 is not hindered by the sheath of an attached cable passing through the second opening 310.

In some embodiments, after translating the attachment unit 300 away from the connector 200 as shown in FIG. 9, if a user releases the attachment unit 300, the spring forces of the actuation lever 330 and/or the release lever 216 can be sufficient to translate the attachment unit 300 back towards the connector 200. In some embodiments, the spring forces can be sufficient to translate the attachment unit 300 to a position immediately adjacent to the connector 200. For example, after the user releases the attachment unit 300, the bias of the living hinge 340 can force the lever portion 334 to rotate about the living hinge 340 (with the living hinge 340 serving as a fulcrum) such that the rear end 338 of the lever portion 334 moves upwards and away from the top surface 328 of the housing. The lever portion 334 can continue to rotate about the living hinge 340 until the lever portion 334 rests against the angled front side 226 of the latch slide 222. This "return" action of the attachment unit 300 can ensure that the shoulders 220 on the release lever 216 of the connector 200 are not accidentally unlatched from the latch groove or obstruction within a port.

Figure 10:
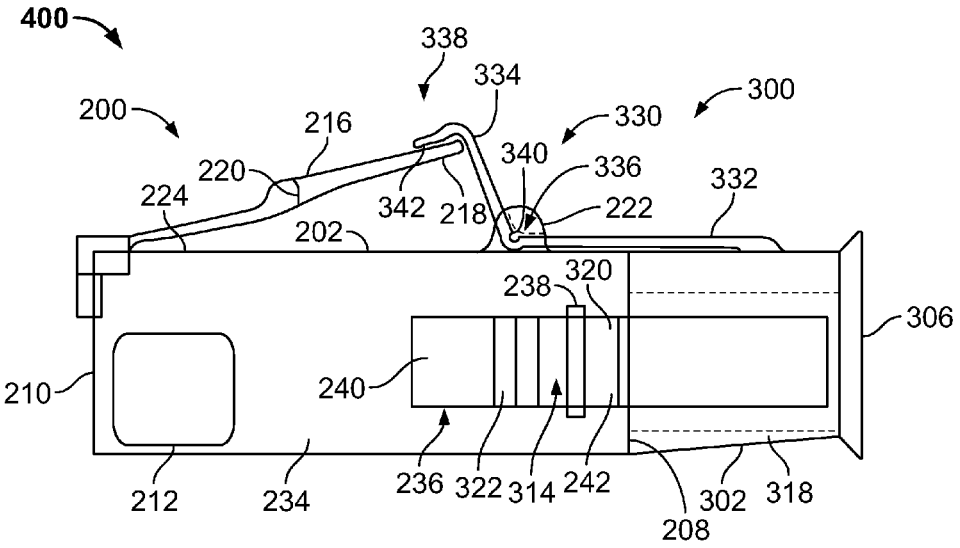
FIG. 10 is a side view of an exemplary modular connector assembly according to the present disclosure.

FIG. 10 shows a side view of an exemplary assembly 400. In particular, the connector 200 and the attachment unit 300 are shown detachably and/or movably interlocked relative to each other. As can be seen, the mating surface 342 of the rear end 338 of the actuation lever 330 is positioned directly above or adjacent to the top surface of the rear end 218 of the release lever 216. Thus, an actuation of the rear end 338 of the actuation lever 330 in a downward direction toward the top surface 224 of the housing 202 by pulling the attachment unit 300 in the direction indicated, i.e., away from the connector 200, forces the rear end 218 of the release lever 216 to simultaneously actuate in a downward direction in the direction of the top surface 224 of the housing 202. In some embodiments, the rear end 306 of the attachment unit 300 can define a curved or flanged edge as shown in FIG. 10 that a user can conveniently grasp when pulling the attachment unit 300 away from the connector 200.

Figure 11:
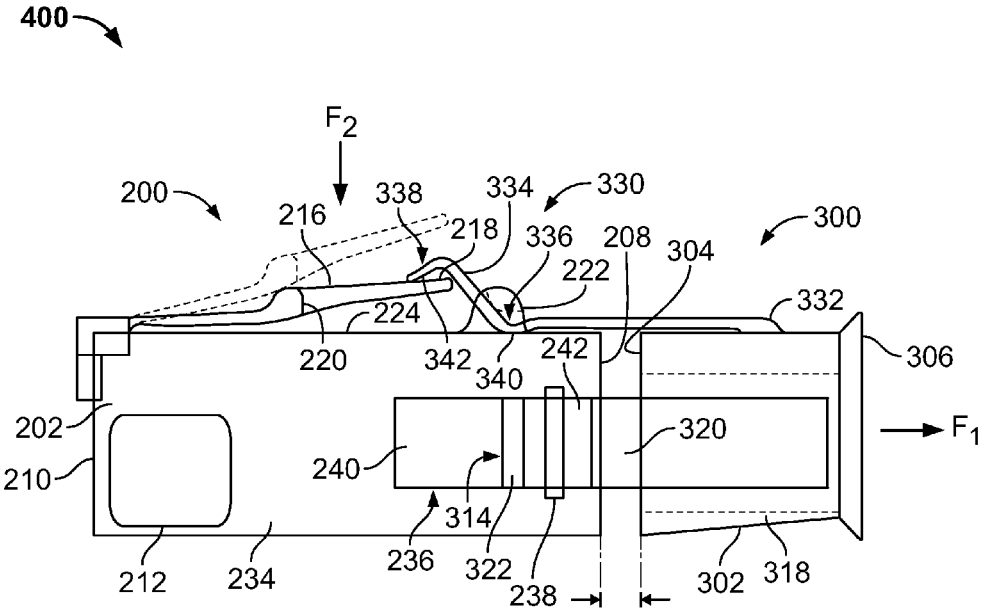
FIG. 11 is a side view of an exemplary modular connector assembly according to the present disclosure.

FIG. 11 shows a side view of an exemplary assembly 400 when the attachment unit 200 is pulled away from the connector 200 by a force $F_1$. The dimensions of the channel 236 can be such that when the attachment unit 200 is pulled away from the connector 200, the catch member 322 of the protrusion 314 can travel within the front channel portion 240 until the catch member 322 abuts the stop member 238 and a distance D exists between the rear end 208 of the connector 200 and the front end 304 of the attachment unit 300 exists. In particular, the distance D can be the distance required for the actuation lever 330 to rotate within the latch slide 222 to depress the release lever 216 sufficiently low to bypass the latch grooves or obstructions within a port which releasably interlock with the shoulders 220 of the release lever 216. Thus, when the attachment unit 200 is pulled away from the connector 200 by a force $F_1$ and a distance D, the mating surface 342 of the actuation lever 330 indirectly applies a force $F_2$ on the rear end 218 of the release lever 216 to depress the release lever 216 in the direction of the top surface 224 of the housing 202. Rather than requiring a user to directly provide a force to the rear end 218 of the release lever 216 to remove the connector 200 from the port, the force $F_2$ can be indirectly applied by pulling on the attachment unit 300. The point of actuation is thereby moved from above the release lever 216 to the rear end 306 of the attachment unit 300, providing the user with a greater area for actuating the assembly 400 for removal from the port. The greater area of actuation reduces or prevents the accidental dislodging or movement of neighboring connectors 200 from their respective ports.

Figure 13:
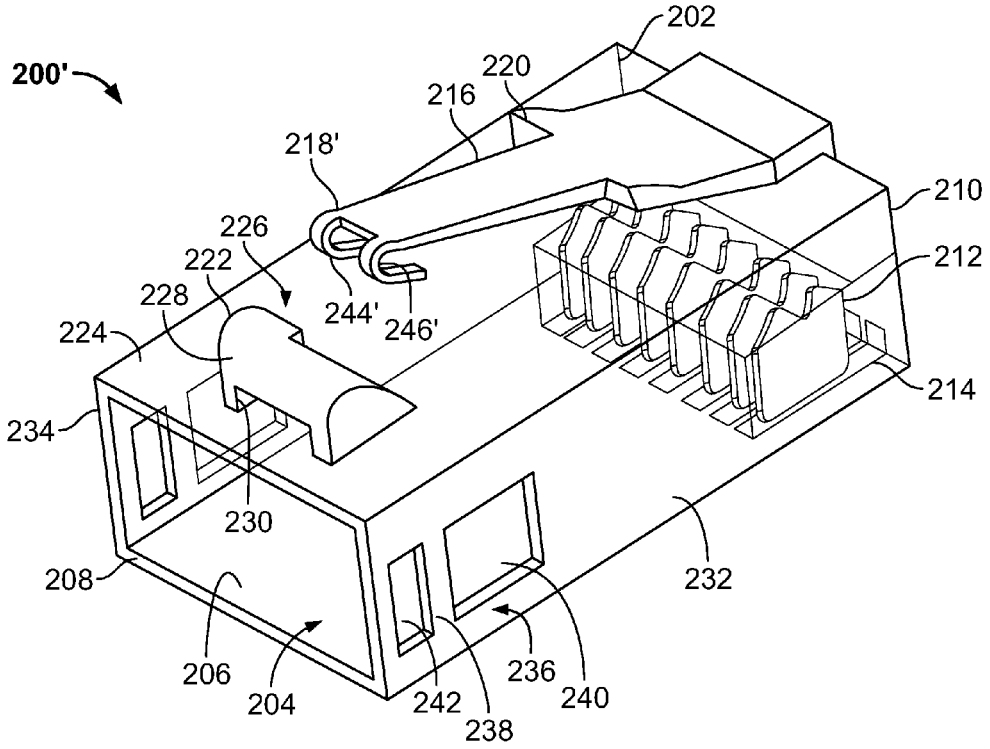
FIG. 13 is a perspective view of an exemplary connector according to the present disclosure.

Turning now to FIG. 13, an exemplary connector 200' for an exemplary modular connector assembly is provided. The connector 200' can be substantially similar in structure and function as the connector 200 described above, except for the rear end 218' of the release lever 216. In particular, the rear end 218 of the release lever 216 of the connector 200 defines a substantially flat surface to be mated with the substantially flat mating surface 342 of the actuation lever 330, while the rear end 218' of the release lever 216 of the connector 200' defines a hooked surface 244' configured and dimensioned to releasably interlock with a pin of an actuation lever 330. The hooked surface 244' generally defines a pocket 246' configured and dimensioned to receive a pin-shaped structure therein.

Figure 14:
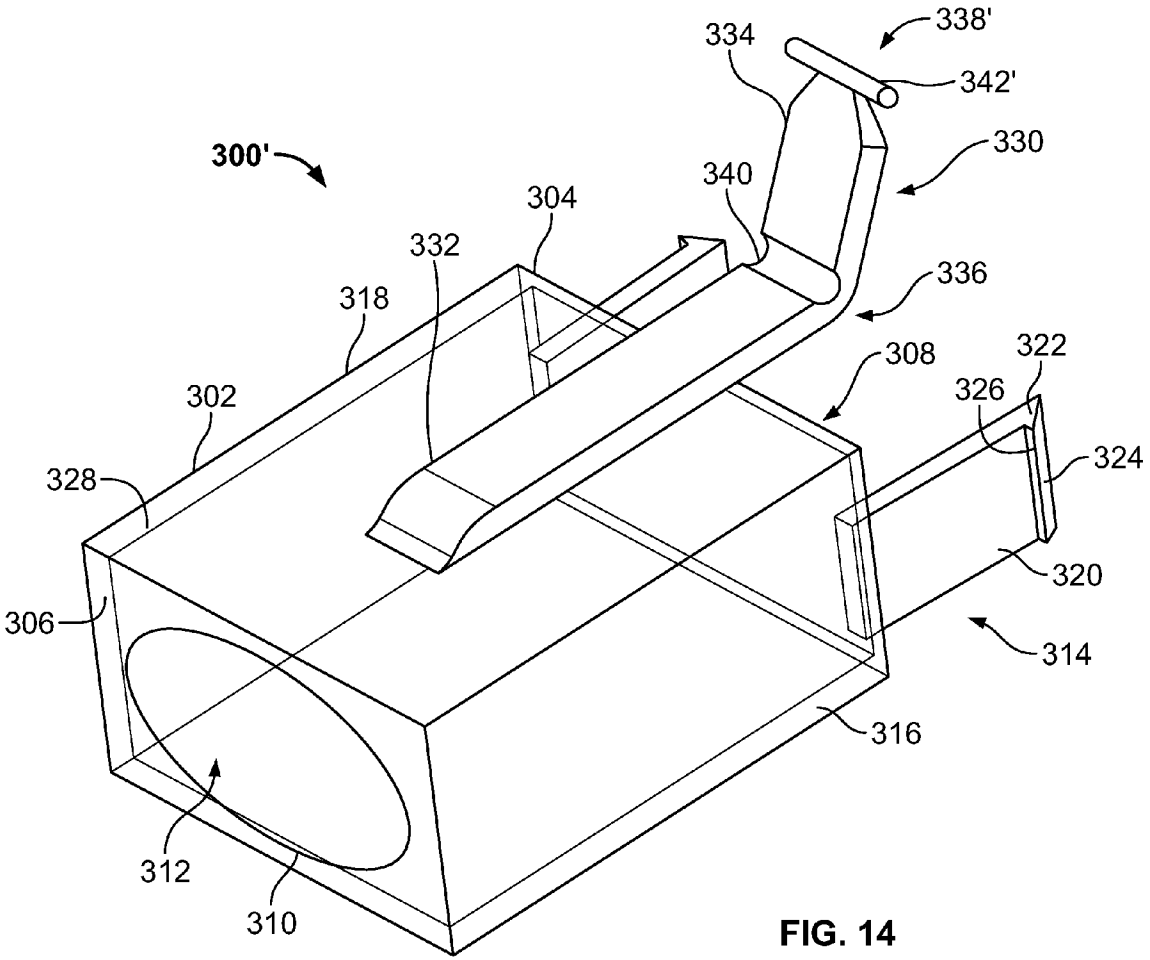
FIG. 14 is a perspective view of an exemplary attachment unit according to the present disclosure.

FIG. 14 shows a perspective view of an exemplary attachment unit 300' configured and dimensioned to releasably interlock with the rear end 218' of the connector 200' of FIG. 13. The attachment unit 300' can be substantially similar in structure and function as the attachment unit 300 describe above, except for the rear end 338' of the actuation lever 330. In particular, the rear end 338 of the actuation lever 330 of the attachment unit 300 defines a substantially flat mating surface 342 to be mated with the substantially flat surface of the rear end 218 of the release lever 216, while the rear end 338' of the actuation lever 330 of the attachment unit 300 defines a mating surface 342' configured as a pin, e.g., a cylindrical pin. The pin-shaped mating surface 342' of the rear end 338' can be releasably interlocked with the hooked surface 244' of the release lever 216 by sliding and/or inserting the pin-shaped mating surface 342' into the pocket 246' of the hooked surface 244'.

The assembly of the connector 200' relative to the attachment unit 300' can be substantially similar to the assembly of the connector 200 relative to the attachment unit 300. The actuation lever 330 can be depressed and passed through the opening 230 of the latch slide 222 until the lever portion 334 is positioned against the angled front side 226 of the latch slide 222, while the protrusions 314 are inserted into the channels 236 until the catch members 322 are advanced past the stop members 238. Once the lever portion 344 is in position against the angled front side 226 of the latch slide 222, the hooked surface 244' of the release lever 216 can be manipulated to surround and receive the pin-shaped mating surface 342' within the pocket 246' of the actuation lever 330.

Figure 15A:
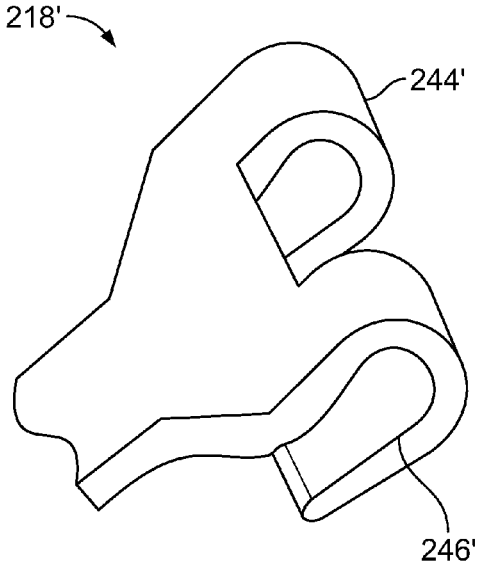
FIGS. 15A-C are perspective views of exemplary rear ends for a release lever and an actuation lever according to the present disclosure.
Figure 15B:
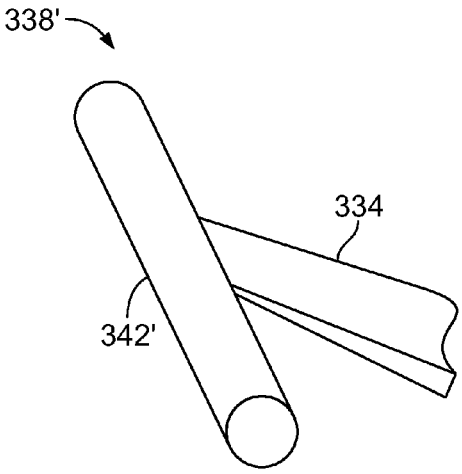
Figure 15C:
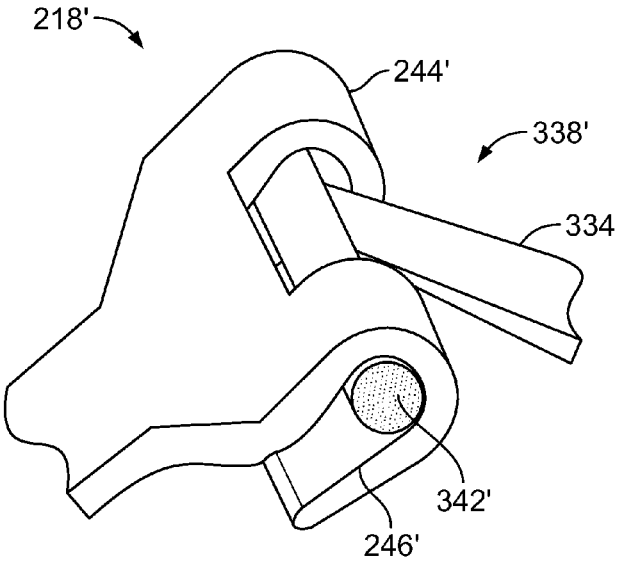

FIGS. 15A-C show perspective views of the exemplary rear end 218' of the release lever 216 and rear end 338' of the actuation lever 330. In particular, FIG. 15A illustrates the hooked surface 244' and pocket 246' of the release lever 216, FIG. 15B illustrates the pin-shaped mating surface 342' of the actuation lever 330, and FIG. 15C illustrates the releasable interlocking between the hooked surface 244' and the pin-shaped mating surface 342'. As can be seen from FIG. 15C, the pin-shaped mating surface 342' can be slid in and out of the pocket 246'.

Figure 16:
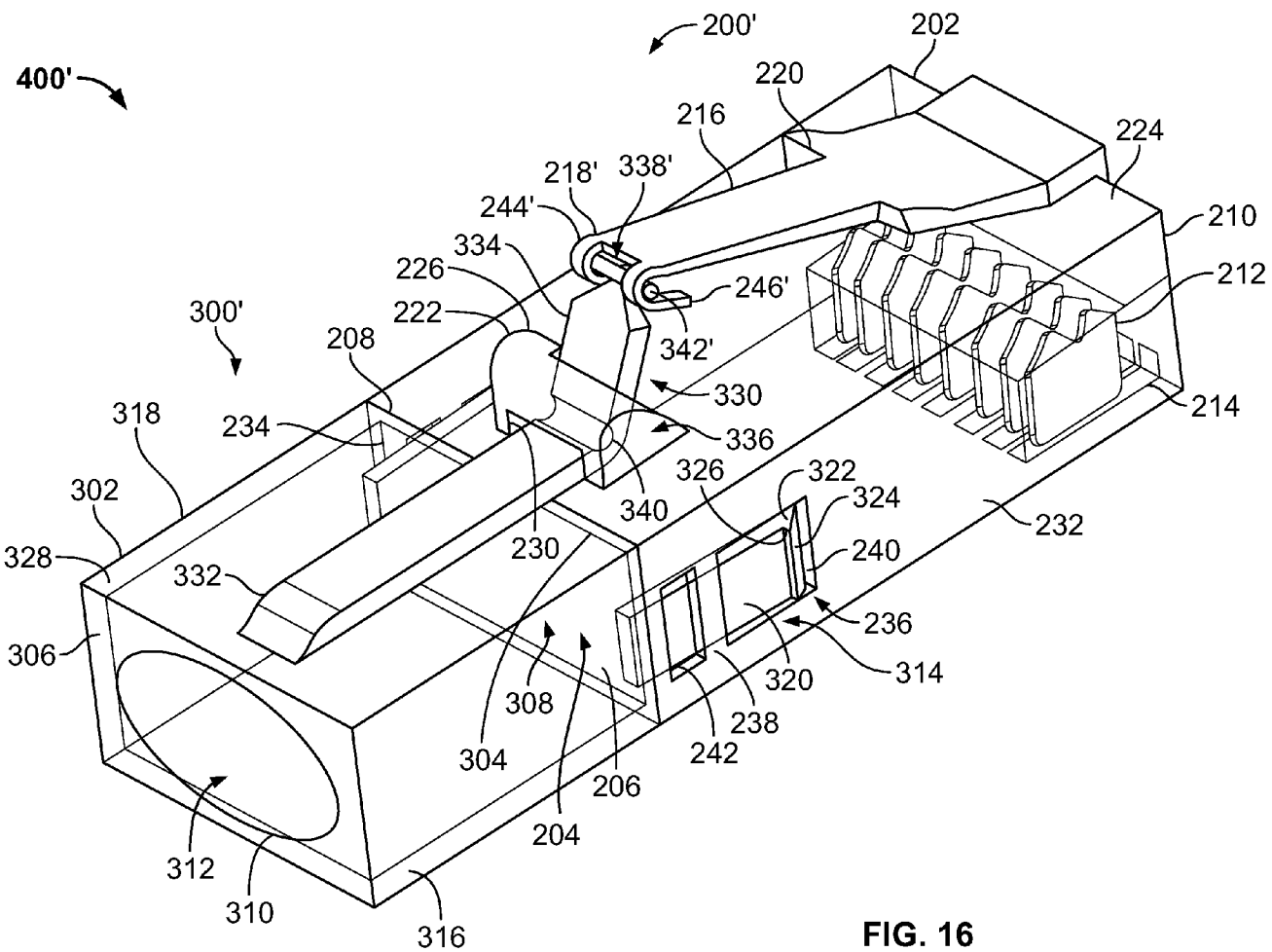
FIG. 16 is a perspective view of an exemplary modular connector assembly according to the present disclosure.

FIG. 16 shows a perspective view of an exemplary modular connector assembly 400' (hereinafter "assembly 400"), including the detachably and/or movably interlocked connector 200' and the attachment unit 300'. The connector 200' and the attachment unit 300' can be interlocked in the same manner as described above for assembly 400. In particular, the actuation lever 330 can be passed through the opening 230 of the latch slide 222 and positioned against the angled front side 226 of the latch slide 222, while the protrusions 314 are advanced into the channels 236 until the catch members 322 have been advanced past the stop member 238. The rear end 338' of the actuation lever 330 can then be interlocked with the rear end 218' of the release lever 216 such that when the lever portion 334 of the actuation lever 330 is actuated in a downward direction toward the top surface 224 of the housing 202 due to a force applied to pull the attachment unit 300' from the connector 200', the release lever 216 can be simultaneously actuated to depress in a downward direction toward the top surface 224 of the housing 202. The shoulders 220 of the release lever 216 can thereby be released from, e.g., a latch groove, located in a port without requiring the user to directly apply a force to the release lever 216.

Figure 17:
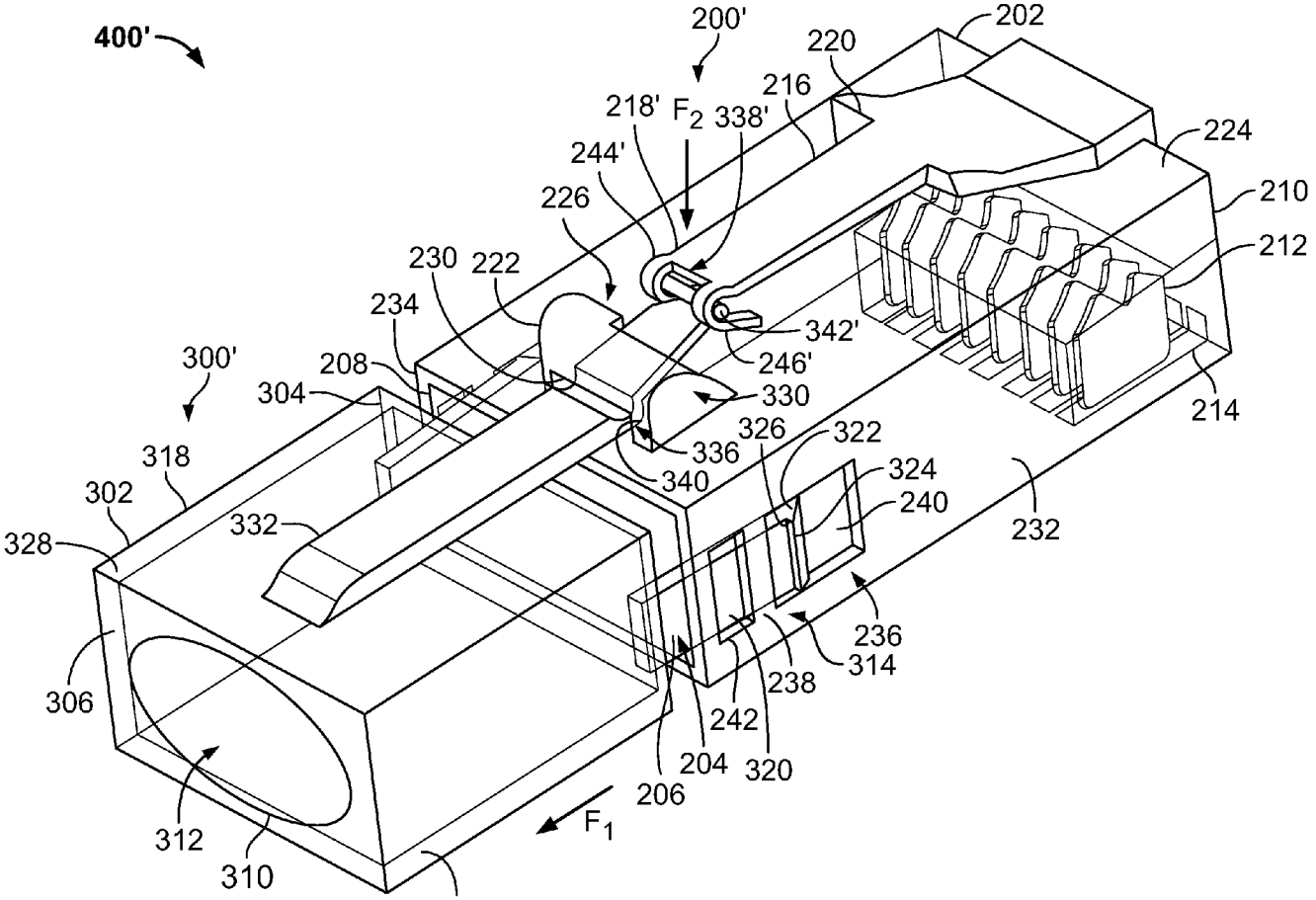
FIG. 17 is a perspective view of an exemplary modular connector assembly with a attachment unit pulled away from a connector according to the present disclosure.

FIG. 17 illustrates the result of a force $F_1$ being applied to the attachment unit 300' away from the connector 200' after the attachment unit 300' and the connector 200' have been interlocked. The hooked surface 444' of the rear end 338' causes the rear end 218' to move or depress downward when the rear end 338' of the lever portion 334 moves downward due to the rearward translation of the attachment unit 300'. In particular, the application of force $F_1$ on the attachment unit 300' indirectly applies a force $F_2$ on the rear end 318' of the release lever 216 to depress the release lever 216 in the direction of the top surface 224 of the housing 202. When the assembly 400' is inserted into a port or jack, the downward motion of the rear end 218' of the release lever 216 causes the shoulders 220 of the release lever 216 to clear the walls of the port, thus permitting removal of the assembly 400' from the port. In particular, rather than requiring a user to directly provide a force to the rear end 218' of the release lever 216 to remove the connector 200' from the port, the force $F_2$ can be indirectly applied by pulling on the attachment unit 300'. The point of actuation is thereby moved from above the release lever 216 to the rear end 306 of the attachment unit 300', providing the user with a greater area for actuating the assembly 400' for removal from the port. The greater area of actuation reduces or prevents the accidental dislodging of neighboring connectors 200' from their respective ports.

Figure 18:
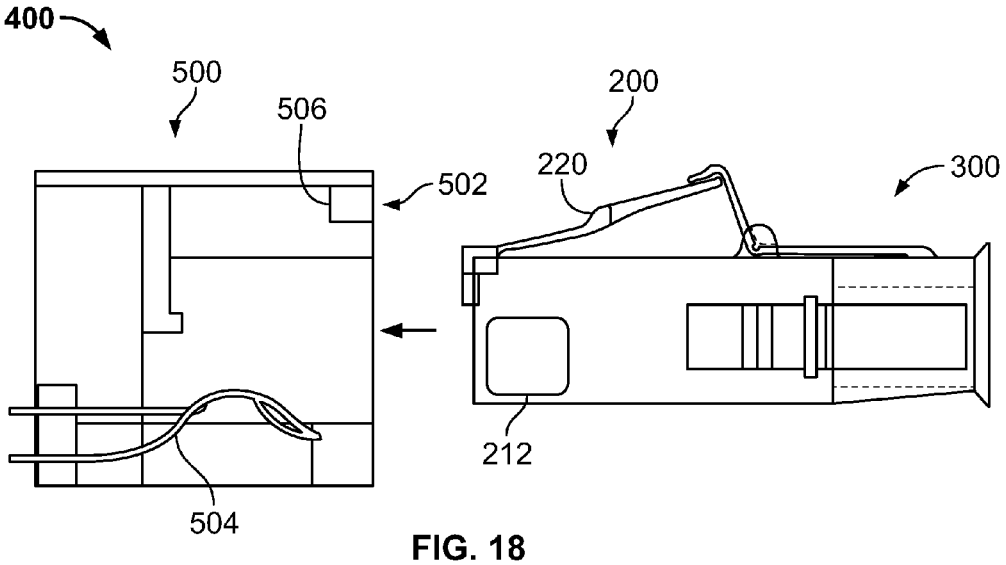
FIG. 18 is a side view of an exemplary modular connector assembly prior to insertion into a port housing.
Figure 19:
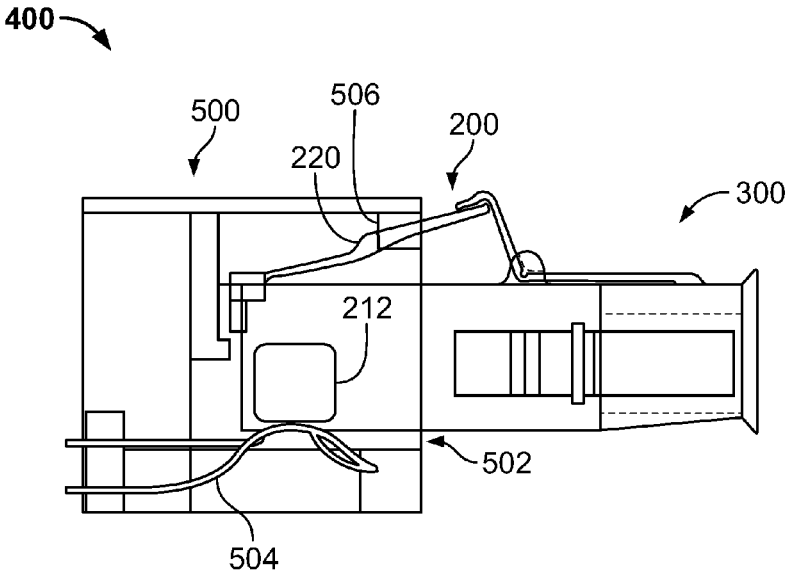
FIG. 19 is a side view of an exemplary modular connector assembly inserted into a port housing.

Turning now to FIG. 18, an exemplary assembly 400 is shown prior to insertion into a port housing 500, e.g., a jack in a networking switch or patch panel. Although illustrated with assembly 400, it should be understood that the description provided herein can apply substantially similarly to the exemplary assembly 400'. The port housing 500 generally includes an opening 502 configured and dimensioned to receive the connector 200. The port housing 500 also includes contact pins 504 made of electrically conductive material for making an electrical connection with the IDCs 212 of the connector 200 and a latch groove 506 (and/or a protrusion) for releasably interlocking with the shoulders 220 of the connector 200. The assembly 400 and, in particular, a portion of the connector 200, can be inserted into the opening 502 until the shoulders 220 on the release lever 216 of the connector 200 releasably interlock with the latch groove 506 of the port housing 500. FIG. 19 shows the assembly 400 inserted into the port housing 500. In particular, the shoulders 220 of the connector 200 have been releasably interlocked with the latch groove 506 of the port housing 500 and the contact pins 504 are in electrical contact with the IDCs 212.

Figure 20:
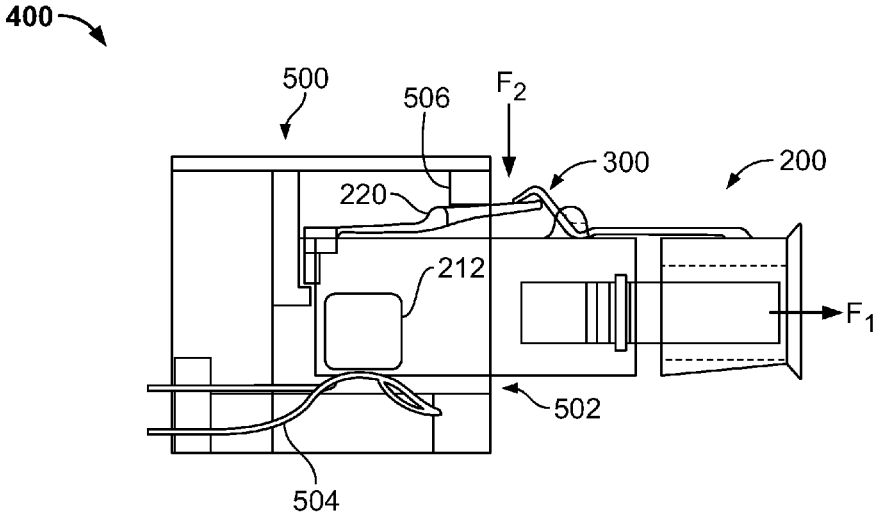
FIG. 20 is a side view of an exemplary modular connector assembly inserted into a port housing.
Figure 21:
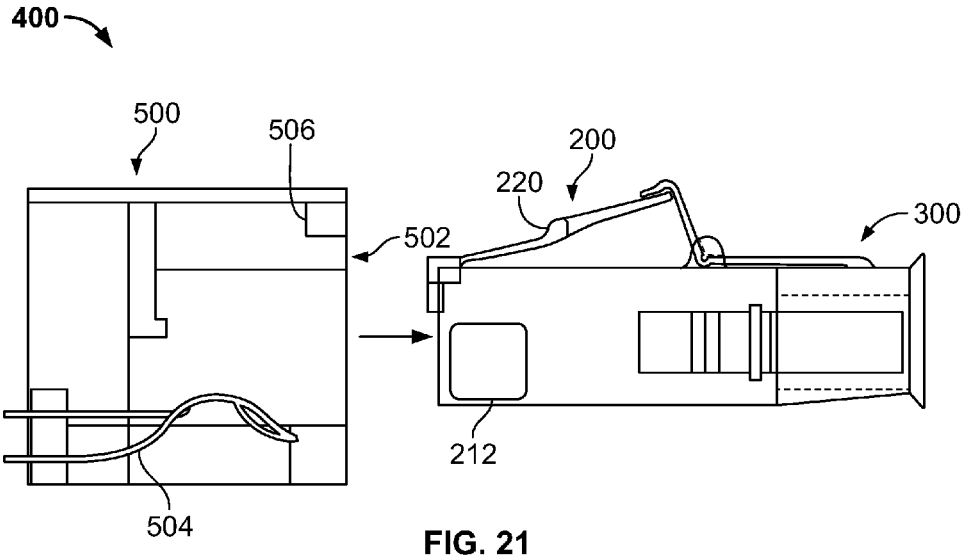
FIG. 21 is a side view of an exemplary modular connector assembly removed from a port housing.

With reference to FIG. 20, the exemplary assembly 400 is shown being removed or detached from the port housing 500. As described above, application of a force $F_1$ on the attachment unit 300 to pull the attachment unit 300 away from the connector 200 indirectly creates a force $F_2$ on the release lever 216 of the connector 200 such that the release lever 216 is depressed sufficiently for the shoulders 220 to be released from the latch groove 506 of the port housing 500. The assembly 400 can then be removed from the opening 502 of the port housing 500, as shown in FIG. 21.

Figure 5A:
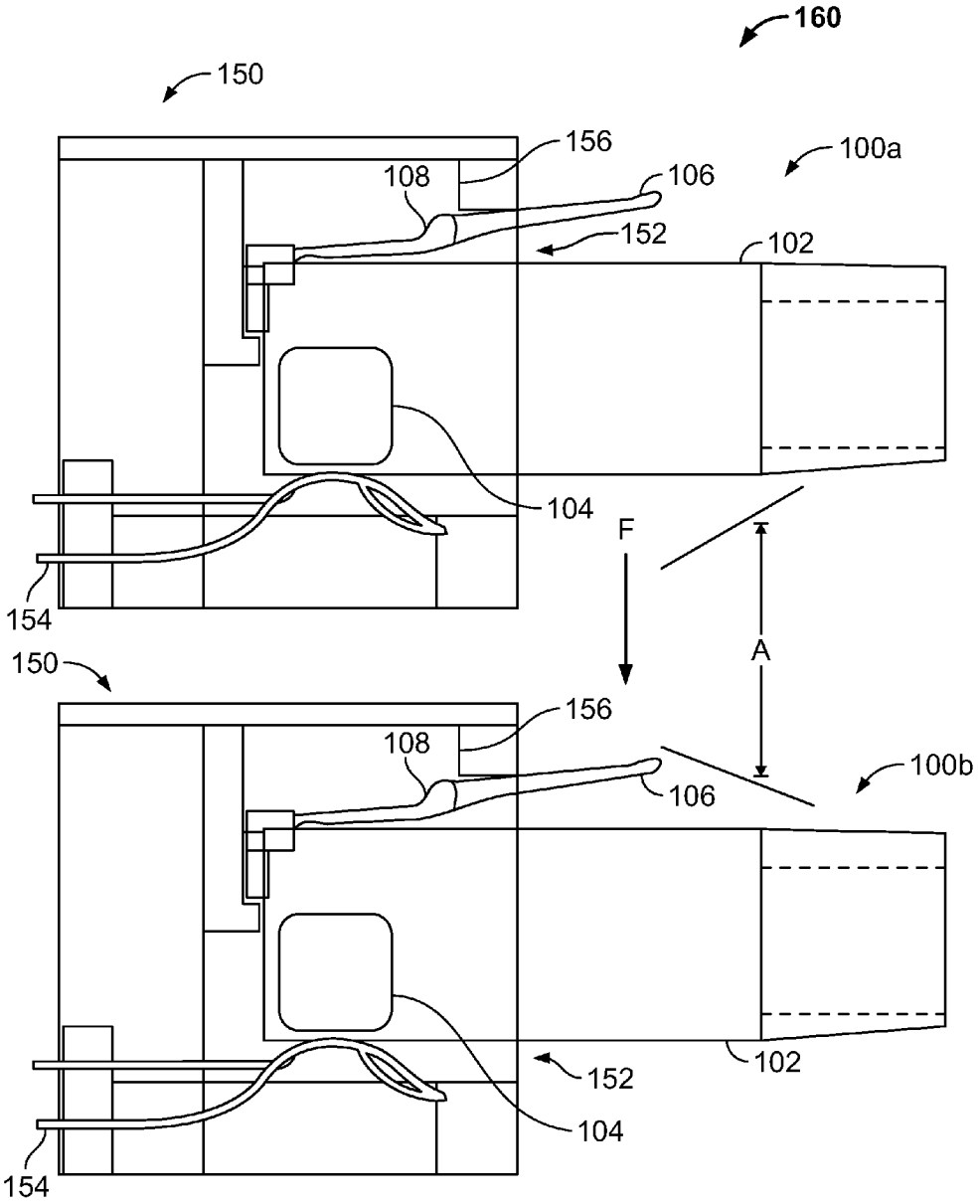
FIG. 5A (Prior Art)
FIGS. 5A and 5B are side views of connectors of the prior art inserted into a multiple connector port housing.
Figure 5B:
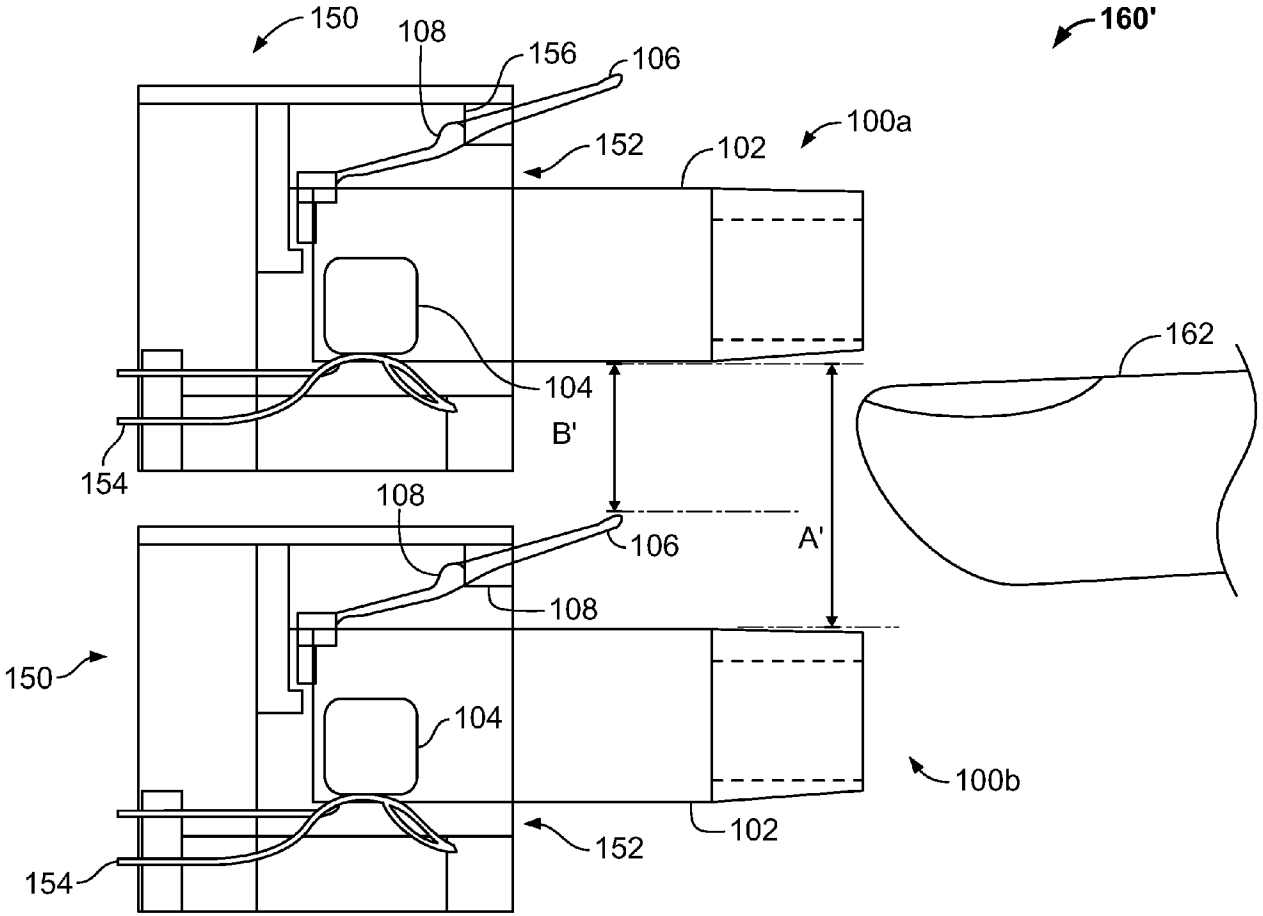
FIG. 5B (Prior Art)
Figure 22:
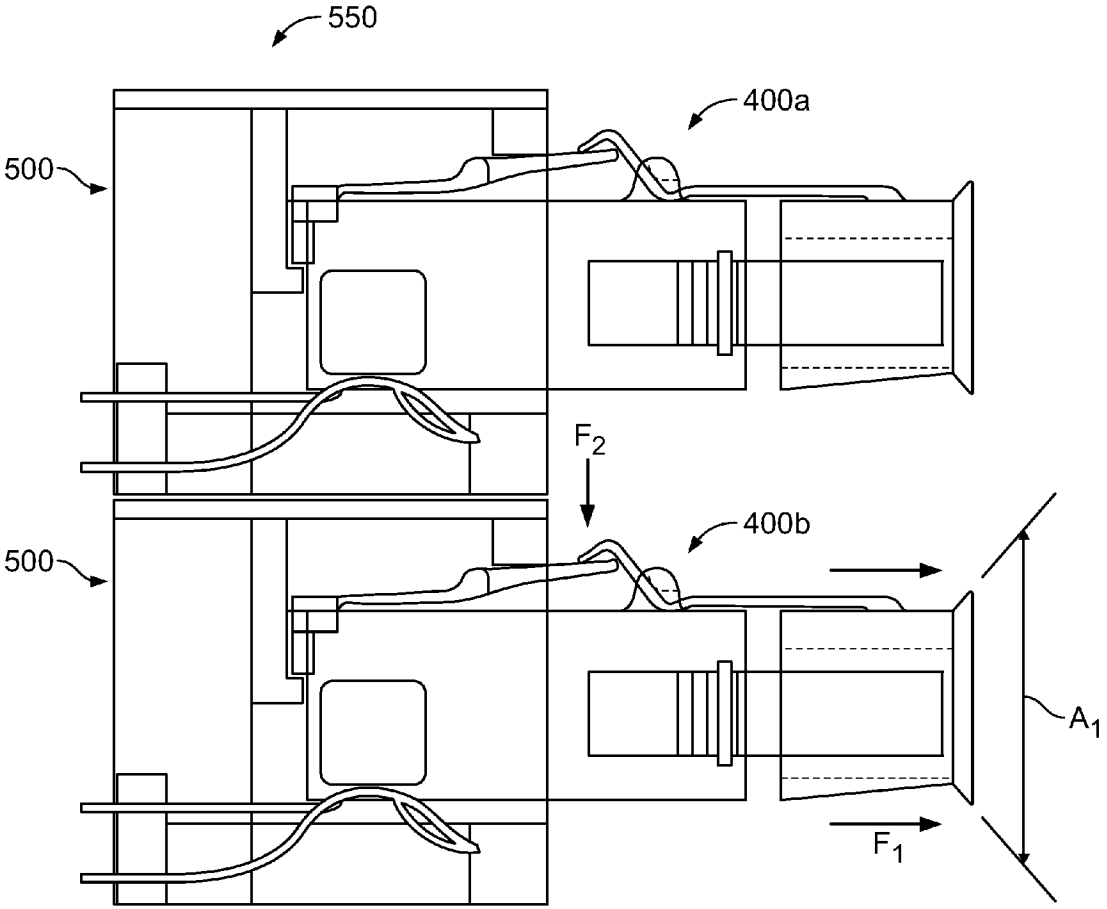
FIG. 22 is a side view of an exemplary modular connector assembly inserted into a multiple connector port housing.

Turning now to FIG. 22, the exemplary assemblies 400 are shown as inserted into port housings 500 of a multiple connector port housing 550, e.g., a multiple port device modular housing, a high-density patch panel, and the like. In particular, the multiple connector port housing 550 includes a top assembly **400*a* and a bottom assembly 400*b* inserted therein. To remove one of the assemblies 400, e.g., bottom assembly 400*b*, from the port 150, only the space directly behind the assembly 400*b* needs to be accessible for imparting the force $F_2$ on the release lever 216. In particular, rather than requiring the user to access the small area between the top assembly 400*a* and the bottom assembly 400*b* connected to ports 150 of a high-density arrangement of ports 150 (as shown in FIGS. 5A and 5B), the exemplary assemblies 400 described herein position the release action point or removal area at a location designated by area $A_1$, i.e., the area at the rear of the assembly 400. As such, a connector 200 of an assembly 400 can be removed from a port 150 in a less cumbersome manner and the risk of interfering with the electrical communications established by neighboring connectors 200 and ports 150** is reduced or prevented.

While exemplary embodiments have been described herein, it is expressly noted that these embodiments should not be construed as limiting, but rather that additions and modifications to what is expressly described herein also are included within the scope of the invention. Moreover, it is to be understood that the features of the various embodiments described herein are not mutually exclusive and can exist in various combinations and permutations, even if such combinations or permutations are not made express herein, without departing from the spirit and scope of the invention.

The invention claimed is:

1. A modular connector assembly, comprising:

a connector that includes a connector housing, the connector housing including a first coupler element, a release lever, and a latch slide, and an attachment unit that includes an attachable unit housing and an actuation lever, the attachable unit housing including a second coupler element, wherein the first coupler element is configured and dimensioned to interlock with the second coupler element for movably securing the connector to the attachment unit.

2. The modular connector assembly of claim 1, wherein a free end of the release lever and a free end of the actuation lever are configured and dimensioned to releasably mate relative to each other.

3. The modular connector assembly of claim 2, wherein when the attachment unit is movably secured to the connector unit, movement of the free end of the actuation lever results in movement of the free end of the release lever.

4. The modular connector assembly of claim 3, wherein when the attachment unit is movably secured to the connector unit, translation of the attachment unit in a direction away from the connector results in movement of the actuation lever.

5. The modular connector assembly of claim 2, wherein the free end of the release lever defines a flat surface and the free end of the actuation lever defines a curved surface.

6. The modular connector assembly of claim 2, wherein the free end of the release lever defines a hook and the free end of the actuation lever defines a pin.

7. The modular connector assembly of claim 2, wherein the actuation lever includes a living hinge.

8. The modular connector assembly of claim 1, wherein the first coupler element comprises two channels and the second coupler element comprises two protrusions.

9. The modular connector assembly of claim 1, wherein the connector includes a latch slide with an opening configured and dimensioned to receive the actuation lever of the attachment unit therethrough and an angled surface configured and dimensioned to receive thereon a surface of the actuation lever.

10. A modular connector system, comprising:

a modular connector assembly that includes (i) a connector that includes a connector housing and a release lever, the connector housing including a first coupler element, and (ii) an attachment unit that includes an attachment unit housing and an actuation lever, the attachment unit housing including a second coupler element, wherein the attachment unit is movably secured to the connector through an interlocking between the first coupler element and the second coupler element, and a port housing configured and dimensioned to releasably secure therein the connector for establishing an electrical communication between a contact inside the connector and a conductive member inside the port housing, wherein translation of the attachment unit in a direction away from the connector releases the connector from the port housing.

11. The modular connector system of claim 10, wherein actuation of the actuation lever results in actuation of the release lever.

12. A method of using a modular connector assembly, comprising:

providing a connector that includes a release lever, providing an attachment unit that includes an actuation lever, assembling the connector and the attachment unit, the attachment unit remaining movable relative to the connector, and moving the attachment unit in a direction away from the connector to actuate the actuation lever of the attachment unit and to actuate the release lever of the connector.

13. The method of claim 12, further comprising, prior to the step of moving the attachment unit in a direction away from the connector, inserting the connector into a port housing to establish electrical communication between a contact in the connector and a conductive member in the port housing.

14. The method of claim 13, further comprising, after the step of moving the attachment unit in a direction away from the connector, removing the connector from the port housing to break the electrical communication between the contact in the connector and the conductive member in the port housing.

15. The method of claim 12, wherein during the step of moving the attachment unit in a direction away from the connector, the attachment unit translates relative to the connector.

16. The method of claim 12, further comprising, after the step of moving the attachment unit in a direction away from the connector, automatically moving the attachment unit in a direction towards the connector.

17. A modular connector assembly, comprising:

a connector that includes a connector housing, the connector housing including a first coupler element, at least one contact located within the connector housing, and a release lever, and an attachment unit that includes an attachment unit housing, the attachment unit housing including a second coupler element, wherein the first coupler element is configured and dimensioned to interlock with the second coupler element to movably secure the connector to the attachment unit, and means for actuating the release lever when the attachment unit is movably secured to the connector.

18. The modular connector assembly of claim 17, further comprising means for allowing a user to grasp a back end of the attachment unit.

* * * * *